US005085693A

United States Patent [19]

Josso et al.

[11] Patent Number: 5,085,693

[45] Date of Patent: Feb. 4, 1992

[54] HYDRAZINE BATH FOR CHEMICAL DEPOSITION OF PLATINUM AND/OR PALLADIUM, AND METHOD OF MANUFACTURING SUCH A BATH

[75] Inventors: Pierre Josso, Issy les Moulineaux; Serge Alperine, Paris; Pierre Steinmetz; Anne Constantini-Friant, both of Vandoeuvre les Nancy, all of France

[73] Assignee: Office National d'Etudes et de Recherches Aerospatiales, Chatillon Sous Bagneux, France

[21] Appl. No.: 597,647

[22] Filed: Oct. 10, 1990

[30] Foreign Application Priority Data

Oct. 11, 1989 [FR] France ..... 89 13294

[51] Int. Cl.[5] ..... C23C 18/44

[52] U.S. Cl. ..... 106/1.28; 427/443.11

[58] Field of Search ..... 106/1.28, 1.21, 1.15

[56] References Cited

U.S. PATENT DOCUMENTS

| | | | |
|---|---|---|---|
| 2,915,406 | 12/1959 | Rhoda | 106/1.28 |
| 3,704,156 | 11/1972 | Foley, Jr. | 106/1.28 |
| 4,006,047 | 2/1977 | Brummett et al. | 106/1.27 |

*Primary Examiner*—William R. Dixon, Jr.
*Assistant Examiner*—Margaret V. Einsmann
*Attorney, Agent, or Firm*—Armstrong, Nikaido, Marmelstein, Kubovcik & Murray

[57] ABSTRACT

The bath contains an oxalate of the metal or of each of the metals to be deposited and hydrazine as a reducing agent, together with ethylenediamine as a complexing agent and at least one stabilizing agent, said bath being highly basic and having an autocatalytic effect.

15 Claims, No Drawings

HYDRAZINE BATH FOR CHEMICAL DEPOSITION OF PLATINUM AND/OR PALLADIUM, AND METHOD OF MANUFACTURING SUCH A BATH

The invention relates to chemical deposition of platinum and/or palladium on a substrate by autocatalytic reduction.

BACKGROUND OF THE INVENTION

The usefulness of a metal deposition bath in industry depends to a large extent on the following three parameters:

absence of objectionable impurities in the deposit;

the possibility of obtaining deposits with a thickness of several microns and in a reasonable period of time, which implies both autocatalytic properties and a deposition speed of several microns per hour; and long lifetime for the bath, and preferably unlimited lifetime with periodical recharging.

On the first point, French patent No. 2 590 595 in the name of the present Applicant and relating to a bath for depositing nickel and/or cobalt describes the advantage of selecting hydrazine as a reducing agent since it does not add any impurity to the deposit. That patent also indicates that numerous anions, and in particular chloride, sulfate, and nitrate anions disturb the operation of hydrazine baths.

U.S. Pat. No. 3,562,911 describes hydrazine baths for chemical deposition of platinum, said baths containing hydrochloric acid and hexachloroplatinic acid, and consequently containing chloride ions. These baths are not autocatalytic and they operate until depleted without it being possible to interrupt the reaction. The platinum efficiency is 91% at most, i.e. at least 9% of the platinum ions contained in the bath are lost.

The object of the invention is to provide an autocatalytic hydrazine bath that does not contain chloride ions and which is capable of being recharged so as to operate over long periods of time.

SUMMARY OF THE INVENTION

The present invention provides an aqueous bath for chemical deposition of platinum and/or palladium, the bath containing a compound of the metal or each of the metals to be deposited, and hydrazine as a reducing agent, the bath being characterized in that said compound is an oxalate and in that the bath contains ethylenediamine as a complexing agent together with at least one stabilizing agent, said bath being highly basic and having an autocatalytic effect.

Advantageously, a bath of the invention for depositing platinum II as a concentration lying in the range about 0.05 gram ions to about 0.15 gram ions, and a bath for depositing palladium contains palladium at a concentration lying between about 0.01 gram ions per liter to about 0.3 gram ions per liter.

The invention also provides a method of preparing a bath as defined above, in which a mother solution is initially prepared containing platinum II or palladium, ethylenediamine, and oxalate anions, after which the stabilizing agent(s) and the hydrazine are added thereto.

For a platinum bath, the concentrations of platinum, of ethylenediamine, and of oxalate, and the pH of the mother solution are substantially the same as they are in the final bath. For a palladium bath, the mother solution is concentrated, i.e. the ions of palladium, of ethylenediamine diamine, and the oxalate anions are present therein at higher concentrations than in the bath, and the mother solution is diluted, possibly with adjustment of its pH, prior to inserting the stabilizing agent and the hydrazine.

In a bath for depositing both platinum and palladium simultaneously, a mother solution containing platinum is mixed with a mother solution containing palladium together with an appropriate quantity of dilution water to obtain the desired concentrations of platinum and of palladium, after which the stabilizing agent(s) and the hydrazine are added.

DETAILED DESCRIPTION

The preparation of a platinum mother solution is now described.

Platinum II compounds and platinum IV compounds are commercially available. Platinum IV compounds are much more stable and consequently much easier to handle than platinum II compounds. Platinum IV compounds therefore give rise to lower costs when used industrially. The commonest platinum IV compounds are hexachloroplatinic acid $H_2PtCl_6$ and hexahydroxoplatinic acid $H_2Pt(OH)_6$.

The latter compound is selected as the starting substance so as to avoid having any chloride anions present because of their objectionable influence on hydrazine oxidation.

In a basic medium and in the presence of a solution of potassium hydroxide, hexahydroxoplatinic acid forms hexahydroplatinic anions $Pt(OH)_6^{2-}$, in which the $Pt^{4+}$ ions are complexed by $OH^-$ anions with a force that is insufficient to ensure stability of the salt relative to the reducing agent constituted by hydrazine. It would therefore be desirable to replace the $OH^-$ ligand with an amine ligand forming a more stable complex. But experiment shows that this replacement cannot take place directly because of the sizes of $OH^-$ ions and of amine ligands, and because of the electrostatic repulsive force between the negative charge on the $OH^-$ ions and the electron pair or "duplet" of nitrogen.

An intermediate complex is therefore formed with oxalate ions in an acid medium. The acid medium eliminates the electrostatic repulsion effect with the amine ligand.

To do this, a sufficient quantity of solid oxalic acid is added to the solution of potassium hexahydroxoplatinate to obtain an acid pH, e.g. about 2:

$$Pt(OH)_6^{2-} + 3H_2C_2O_4 \rightarrow Pt(CO_4)_2 + C_2O_4^{2-} + 6\text{-}H_2O$$

At this stage, the solution is green in color. After resting a few hours, it is observed that carbon dioxide gas is given off and the solution turns dark blue. The oxalate ions have reduced the platinum IV to oxidation number II in accordance with the reaction:

$$Pt(C_2O_4)_3^{2-} \rightarrow 2CO_2 + Pt(C_2O_4)_2^{2-}$$

The reduction is limited to the II state rather than the metallic state because the platinum is present in a complexed form which is more difficult to reduce.

This prior reduction of the platinum is advantageous since it reduces the quantity of hydrazine that is required to reduce it to the metallic state.

The platinum-ethylenediamine complex is obtained by neutralizing the acid solution of platinum II oxalate by means of an excess of anhydrous ethylenediamine. This weak dibase ($pK_1=6.9$, $pK_2=10.0$) brings the pH to a value lying between 8 and 10 when it is used at a concentration of at least 4 moles of ethylenediamine per gram ion of platinum II, which corresponds to twice the stoichiometric quantity required for forming the complex of coordination number II. The pH can then be adjusted to a higher value by adding potassium hydroxide.

The palladium mother solution is prepared using palladium chloride $PdCl_2$ as the starting substance since that is the only palladium compound which is available in practice.

This salt is soluble in an aqueous solution of hydrochloric acid.

A sufficient quantity of potassium hydroxide is added to the solution obtained to raise the pH above 8, thereby precipitating palladium in the form of the hydroxide $Pd(OH)_2$ which is collected by filtering under suction.

The dark tan color palladium hydroxide is then put into solution in a solution of oxalic acid, thereby obtaining a solution having a dark reddish-brown color with a pH lying between 1 and 2.

This solution is then neutralized by adding anhydrous ethylenediamine until a pH of about 10 is reached. A mother solution is thus obtained in which the palladium is complexed by the ethylenediamine. This solution is concentrated and contains at least 0.1 gram ions of palladium, i.e. at least 10 grams per liter (g/l) of palladium metal.

In order to obtain a platinum-plating bath, the following steps are performed:

A quantity of mother solution is taken equal to the volume of the desired bath.

A primary stabilizing agent such as arsenic pentoxide is put into solution.

One or more secondary stabilizing agents selected from imidazole, benzotriazole, copper sulfate, lead acetate, iodic acid, and glycocoll is/are put into solution.

The reducing agent (hydrated hydrazine) is added.

After being brought to its operating temperature, the bath is ready for use.

A bath for palladium plating is obtained as follows:

A volume of mother solution containing the desired quantity of palladium ions is diluted using distilled water to make up a bath of the desired volume.

A primary stabilizing agent, e.g. arsenic pentoxide, is put into solution.

One or more secondary stabilizing agents selected from imidazole, benzotriazole, copper sulfate, lead acetate, iodic acid, and glycocoll is/are put into solution.

The reducing agent (hydrated hydrazine) is added.

After bringing to its operating temperature, the bath is ready for use.

EXAMPLE 1: PREPARING A PLATINUM MOTHER SOLUTION

To prepare 1 liter of mother solution, the following is performed:

- 1 mole of potassium hydroxide is dissolved in 0.5 ( of distilled water;
- 0.1 moles of hexahydroxoplatinic acid is added, and a solution is obtained having a reddish-brown color;
- 4 moles of oxalic acid and about 1 l of distilled water are added, with the solution becoming beige in color;
- the solution is heated to 50° C. to finish off dissolving the crystals of oxalic acid and neutralizing the hexahydroxoplatinate, with the solution taking on a green tint;
- after standing for 16 hours, the solution turns dark blue by virtue of the platinum IV being reduced to platinum II;
- 1.2 moles of anhydrous ethylenediamine are added and the solution becomes dark yellow;
- the solution is heated to 90° C. in order to reduce its volume to 1 l, and it is filtered to obtain a clear solution having a pH of 8; and
- potassium hydroxide is added until a pH of 13 is reached, after which the solution is filtered in order to remove the potassium oxalate precipitate.

One liter of the resulting mother solution contains 0.1 gram ions of platinum, 1.2 moles of ethylenediamine, and about 0.1 gram ions of oxalate.

It is not possible to prepare a solution of significantly higher concentration without running the risk of it being unstable and causing platinum salts to precipitate.

EXAMPLE 2: PREPARING A MOTHER SOLUTION OF PALLADIUM

The following steps are performed:

- 0.17 l of 37% hydrochloric acid are added to 0.18 l of distilled water to obtain 0.35 l of a 5M hydrochloric acid solution;
- 35 g of palladium chloride are added, thereby obtaining a clear solution having a reddish-brown color;
- simultaneously a 7.5M solution of potassium hydroxide is prepared;
- the solution of palladium chloride is neutralized using the potassium hydroxide solution, thereby obtaining a palladium hydroxide precipitate which is recovered by filtering under suction on No. 3 sintered glass and by washing using the same solution of potassium hydroxide;
- the palladium hydroxide is put into solution in a molar solution of oxalic acid; and
- ethylenediamine is added to obtain a pH of not less than 9.

This solution may be stored directly or it may be concentrated, 1 l of a typical concentrated mother solution contains 0.1 to 0.2 gram ions of palladium and 0.1 gram ions to 0.19 gram ions of oxalate, with its pH lying in the range 9 to 12 depending on the quantities of reagent used and on the final degree of concentration. Its ethylenediamine concentration is adjusted to 1M.

EXAMPLES 3 AND 4: PLATINUM BATHS

EXAMPLE 3

The following ingredients are added at the following concentrations to the mother solution of Example 1:

- primary stabilizing agent: arsenic pentoxide $6.5\times10^{-4}$M;
- secondary stabilizing agent: imidazole 0.3M;
- reducing agent: hydrated hydrazine 1M.

The pH of this bath is 13. It is used at 90° C. to plate a nickel-based IN100 alloy plate having approximate dimensions of 10mm×13 mm×2 mm. A constant plating speed of 1 micron per hour is obtained over a period of two hours by periodically recharging the bath in conventional manner after taking measurements. The resulting deposit is pale gray and semishiny. Its surface aspect is dense and nodular, which observations are confirmed by metallographic examination on a polished section.

EXAMPLE 4

The mother solution of Example 1 is used to prepare a bath having the following composition in moles:

Pt: 0.1
ethylenediamine: 3.1
oxalate: about 0.1 (quantity remaining after precipitation)
sufficient potassium hydroxide to obtain a pH > 13
arsenic pentoxide: $6.5 \times 10^{-4}$
imidazole: 0.5
hydrated hydrazine: 4.1

The substrate treated is a Z10 NCD18-10 stainless steel plate having approximate dimensions of 20 mm×20 mm×2 mm and previously nickel plated. A plating speed of 1 micron per hour is obtained over a period of 1 hour 40 minutes at a temperature of 82° C.

EXAMPLES 5-18: PALLADIUM BATHS

EXAMPLE 5

Starting with the mother solution of Example 2, a bath is prepared having the following composition in moles.

palladium: 0.02
ethylenediamine: 1.5
oxalate: 0.19
arsenic pentoxide: $10^{-3}$
imidazole: 0.2
hydrazine: 1

The pH of this bath is 10.5.

This bath is used to plate a nickel plate having approximate dimensions of 10 mm×10 mm×2 mm at a temperature Of 70° C. The plating speed obtained is 2 microns per hour over a period of 1 hour.

EXAMPLE 6

The bath differs from the preceding bath in that the concentration of ethylenediamine is 2M.

Under the same conditions of use, a plating speed of 3 microns per hour is obtained for 1 hour.

EXAMPLE 7

The ethylenediamine concentration of the bath is raised to 3M, other things remaining equal.

The plating speed is 4 microns per hour over 1 hour.

EXAMPLE 8

The bath is similar to the preceding baths, but the concentration of ethylenediamine is 4M.

At 70° C. the plating speed rises to 5 microns per hour for a period of 1 hour.

EXAMPLE 9

A bath similar to that of Example 5 is prepared except that the concentration of imidazole is 0.3M.

Under the same conditions of use, a plating speed of 6 microns per hour is obtained over 4 hours.

EXAMPLE 10

The bath differs from those of Examples 5 and 9 by having an imidazole concentration of 0.4M.

Other things remaining equal, a plating speed of 6 microns per hour is obtained for a period of 5 hours.

EXAMPLE 11

The imidazole concentration of the bath is raised to 0.5M, without making other changes.

The plating speed becomes 4.5 microns per hour for a period of 2 hours.

EXAMPLE 12

Using the mother solution of Example 2, a bath is prepared having the following composition, in moles:

palladium: 0.1
ethylenediamine: 3
oxalate: 0.5
arsenic pentoxide: $10^{-3}$
imidazole: 0.4
hydrazine: 1

Its pH is equal to 9.

Under the same conditions of use as the preceding example, a plating speed of 5 microns per hour is obtained for a period of 5 hours.

EXAMPLE 13

The bath differs from that of Example 12 by the arsenic pentoxide being replaced by copper sulfate at a concentration of $1.7 \times 10^{-4}$M, with the pH being 9.5.

Under the same conditions of use, a plating speed of 5 microns per hour is obtained for a period of 8 hours, which represents a palladium coating having a thickness of 40 microns. Such a coating has never previously been obtained by autocatalytic chemical deposition.

EXAMPLE 14

The bath differs from that of Example 12 by arsenic pentoxide being replaced with the same concentration of potassium iodate, and the pH is again equal to 9.5.

Still under the same conditions, a plating speed of 1.5 microns per hour is obtained for a period of 10 hours.

EXAMPLE 15

The bath differs from that of the previous Example in that the concentration of potassium iodate is reduced to $10^{-4}$M.

Under the usual conditions of use, a plating speed of 2.5 microns per hour is observed over a period of 10 hours.

EXAMPLE 16

The bath differs from that of the two preceding examples in that the concentration of potassium iodate is reduced to $10^{-5}$M.

Under the same conditions of use, a plating speed of 4.5 microns per hour is obtained over a period of 30 hours giving a total thickness of 135 microns. The hardness of the deposit is about 450 $HV_{25}$, which is comparable to that of an autocatalytic chemical deposit of nickel. Analyzing this deposit using an electron microprobe shows that it contains palladium only down to the detection limit of this technique.

The same bath at a temperature of 60° C. provides a plating speed of 1.5 microns per hour for a period of 3 hours.

EXAMPLE 17

Using the same mother solution as of Example 2, a bath is prepared having the following composition in moles:

palladium: 0.19
ethylenediamine: 1 oxalate: 0.19
arsenic pentoxide: $6.5\times10^{-4}$
imidazole: 0.3
hydrazine: 0.14 with the pH being raised to a value of not less than 13 by potassium hydroxide.

This bath is suitable for use in a temperature range 75° C. to 90° C., with the plating speed varying between 4 microns/hour and 25 microns/hour. The deposit obtained has column type growth giving a very sound surface appearance which is slightly cracked in its outer portion (fast growth deposition).

EXAMPLE 18

The bath of Example 16 is used for coating a silicon carbide ceramic plate having approximate measurements of 10 mm×8 mm×3 mm and previously subjected to an appropriate surface treatment. By way of example, this surface treatment may comprise the following steps:

a) chemical degreasing at 90° C. for a period of 10 minutes in a solution having the following composition:
sodium hydroxide: 120 g/l
trisodium phosphate: 100 g/l
sodium perborate $NaBO_2.H_2O_2.H_2O$: 50 g/l
wetting agent (Teepol type): 100 ml/l
b) after careful washing in distilled water, immersion in a hydrochloric solution having 5 g/l of palladium chloride for a period of 10 minutes to 15 minutes;
c) further washing in distilled water followed by immersion in pure hydrated hydrazine for a period of 3 minutes to 5 minutes; and
d) further washing in distilled water.

The plate is then inserted in the bath of the invention and the deposition reaction starts as soon as the temperature of the surface reaches the temperature of the bath.

At a temperature of 70° C., a plating speed of 4.5 microns per hour is obtained for a period of 2 hours. The deposit is sound and adheres well.

EXAMPLE 19: A BATH FOR DEPOSITING A PALLADIUM-PLATINUM ALLOY

Using the mother solutions of Examples 1 and 2, a bath is prepared having the following composition, in moles:

palladium: 0.03
platinum II: 0.06
ethylenediamine: 2.7
oxalate: 0.2
arsenic pentoxide: $10^{-3}$
imidazole: 0.4
hydrazine: 1

The pH of this bath is equal to 10.5. Under the same conditions of use as Examples 5 to 15, a plating speed of 3 microns per hour is obtained for a period of 1 hour. Analysis of the deposit shows that it comprises an alloy having 80% palladium and 20% platinum by mass.

The lifetime of baths of the invention is practically unlimited providing they are periodically recharged.

Tables 1 and 2 show the composition ranges and the conditions of use of platinum baths and of palladium baths respectively. Bath "loading" is the ratio between the area to be coated and the volume of the bath. The "min" and "max" columns are limit values. The "optimal" column gives the preferred value or range of values for each parameter.

The stability of baths of the invention make it possible to insert particles into the baths for inclusion in the deposits, as described in above-mentioned U.S. Pat. No. 2,590,595. These particles (ceramics such as alumina or yttria, metals or alloys) are obtained by crushing in the presence of the mother solution and of a deflocculating agent.

TABLE 1

| Substance or parameter | Min | Max | Optimal |
|---|---|---|---|
| II platinum | 0.05 | 0.15 | 0.10 |
| ethylenediamine | 0.10 | 4.0 | 1 to 3 |
| oxalate anions | ·0.05 | 0.15 | 0.10 |
| arsenic pentoxide | $10^{-5}$ | $5\times10^{-3}$ | $6.5\times10^{-4}$ |
| imidazole | $2\times10^{-1}$ | $5\times10^{-1}$ | $3.10^{-1}$ |
| hydrated hydrazine | $5\times10^{-2}$ | 5 | 1 to 4 |
| pH | 10 | 14 | 13 |
| temperature (°C.) | 70 | 105 | 80 to 90 |

TABLE 2

| Substance or parameter | Min | Max | Optimal |
|---|---|---|---|
| II palladium | $10^{-2}$ | 0.3 | 0.1 to 0.2 |
| oxalate anions | 0.01 | 0.3 | 0.1 to 0.2 |
| ethylenediamine | 1 | 4 | 2 to 3 |
| arsenic pentoxide | $10^{-4}$ | $10^{-2}$ | $10^{-3}$ |
| or copper sulfate | $10^{-5}$ | $10^{-3}$ | $2\times10^{-4}$ |
| or potassium iodate | $10^{-6}$ | $10^{-3}$ | $10^{-5}$ |
| imidazole | 0.2 | 0.6 | 0.4 |
| hydrated hydrazine | 0.1 | 2.5 | 1 |
| pH | 8.5 | 14 | 9.5 |
| temperature (°C.) | 40 | 105 | 70 |
| bath loading ($dm^2/l$) | | 3 | <2 |

We claim:

1. An aqueous bath for chemical deposition of platinum and/or palladium, said bath comprising an oxalate compound of the metal or each of the metals to be deposited, hydrazine as a reducing agent, ethylenediamine as a complexing agent, and at least one stabilizing agent, wherein said bath contains essentially no chloride ions, is highly basic and has an autocatalytic effect.

2. A bath according to claim 1, containing platinum II at a concentration lying in the range about 0.05 gram ions to about 0.15 gram ions.

3. A bath according to claim 2, containing the following ingredients in the following molar ranges:
ethylenediamine: 0.1 to 4
oxalate anions: 0.05 to 0.15
arsenic pentoxide: $10^{-5}$ to $5\times10^{-3}$
imidazole: 0.2 to 0.5
hydrazine: 0.05 to 5
its pH lying in the range about 10 to about 14.

4. A bath according to claim 3, wherein its composition in moles is substantially as follows:
platinum II: 0.1
ethylenediamine: 1 to 3
oxalate anions: 0.1
arsenic pentoxide: $6.5\times10^{-4}$
imidazole: 0.3
hydrazine: 1 to 4
its pH being about 13.

5. A method of preparing a bath according to claim 2, comprising the steps of:
(1) preparing initially a mother solution which is a solution having the same components as said bath except for containing no stabilizing agent and no hydrazine, said mother solution containing platinum II, ethylenediamine, and oxalate anions at substantially the same concentrations as in said bath and having substantially the same pH as said bath; and (2) adding subsequently said stabilizing agent and hydrazine to the mother solution to obtain said bath.

6. A method according to claim 5, wherein the mother solution preparation comprises the following steps:

a) hexachloroplatinic acid is added to an aqueous solution of potassium hydroxide;

b) oxalic acid is added, and the solution is heated to dissolve the oxalic acid and cause it to react with the potassium hexachloroplatinate;

c) the solution is allowed to stand until the solution turns dark blue;

d) ethylenediamine is added, and the solution is filtered; and e) its pH is adjusted by adding potassium hydroxide until a pH of at least 13 is reached.

7. A method according to claim 6, including the following additional features:

the quantity of oxalate acid used is about 40 moles per gram ion of platinum;

the quantity of ethylenediamine used is not less than 4 moles per gram ion of platinum;

after adding the ethylenediamine and prior to filtering, the solution is concentrated by evaporation; and after adjusting the pH, the solution is filtered again in order to remove precipitated potassium oxalate.

8. A bath according to claim 1, containing palladium at a concentration lying between about 0.01 gram ions per liter to about 0.3 gram ions per liter.

9. A bath according to claim 8, containing the following components in the following molar ranges:

ethylenediamine: 1 to 4
oxalate anions: 0.02 to 0.3
arsenic pentoxide: $10^{-4}$ to $10^{-2}$
or copper sulfate: $10^{-5}$ to $10^{-3}$
or potassium iodate: $10^{-6}$ to $10^{-3}$
imidazole: 0.2 to 0.6
hydrazine: 0.1 to 2.5 its pH lying between about 8.5 and about 14.

10. A bath according to claim 9, wherein its composition in moles is substantially as follows:

palladium: 0.1 to 0.2
oxalate anions: 0.1 to 0.2
arsenic pentoxide: $10^{-3}$
or copper sulfate: $2\times10^{-4}$
or potassium iodate: $10^{-5}$
imidazole: 0.4
hydrazine: 1 its pH being about 1.5.

11. A method of preparing a bath according to claim 8, comprising the steps of:

(1) preparing initially a mother solution which is a solution having the same components as said bath except for containing no stabilizing agent and no hydrazine, said mother solution containing palladium ions, ethylenediamine, and oxalate anions at concentrations which are higher than in said bath;

(2) diluting with water the mother solution until the concentrations of platinum II, ethylenediamine, and oxalate anions are substantially equal to the respective concentrations of platinum II, ethylenediamine, and oxalate anions in said bath; and (3) adding said stabilizing agent and hydrazine to the diluted mother solution obtained in step (2) to obtain said bath.

12. A method according to claim 11, wherein the mother solution preparation comprises the following steps:

a) palladium chloride is dissolved in an aqueous solution of hydrochloric acid;

b) the solution is neutralized by adding an aqueous solution of potassium hydroxide until palladium precipitates in the form of a hydroxide;

c) the solution is filtered to collect the palladium hydroxide;

d) the palladium hydroxide is dissolved in an aqueous solution of oxalic acid; and e) anhydrous ethylenediamine is added until a pH of about 10 is obtained.

13. A method of preparing a bath for the simultaneously depositing of platinum and palladium, wherein said bath contains essentially no chloride ions and comprises platinum II oxalate, palladium oxalate, hydrazine as a reducing agent, ethylenediamine as a complexing agent, and at least one stabilizing agent, said process comprising the steps of:

(1) preparing a platinum mother solution which is a solution having the same components as said bath except for containing no palladium ions, no stabilizing agent and no hydrazine, said platinum mother solution containing platinum II ions, ethylenediamine, and oxalate anions at concentrations which are higher than in said bath;

(2) preparing a palladium mother solution which is a solution having the same components as said bath except for containing no platinum ions, no stabilizing agent and no hydrazine, said palladium mother solution containing palladium ions, ethylenediamine, and oxalate anions at concentrations which are higher than in said bath;

(3) mixing said platinum mother solution with said palladium mother solution;

(4) diluting the mixture of mother solutions obtained in step (3); and (5) adding said stabilizing agent and hydrazine to the diluted mixture of mother solutions obtained in step (4) to obtain said bath.

14. A mother solution as prepared by implementing the method of claim 5, and having substantially the following composition in moles:

platinum II: 0.1
oxalate ions: 0.1
ethylenediamine: 1.2 and having a pH of about 13.

15. A mother solution prepared by implementing the method of claim 11, and having substantially the following molar composition:

palladium: 0.1 to 0.2
oxalate ions: 0.1 to 0.19
ethylenediamine: 1 its pH lying in the range 9 to 12.

* * * * *